US011211743B2

(12) United States Patent
Briant et al.

(10) Patent No.: US 11,211,743 B2
(45) Date of Patent: Dec. 28, 2021

(54) RECEPTACLE MODULE AND RECEPTACLE CAGE FOR A COMMUNICATION SYSTEM

(71) Applicant: TE Connectivity Services GmbH, Schaffhausen (CH)

(72) Inventors: Eric David Briant, Dillsburg, PA (US); Dean Marlin Harmon, III, Etters, PA (US); Randall Robert Henry, Lebanon, PA (US); Michael John Phillips, Camp Hill, PA (US); Christopher David Ritter, Hummelstown, PA (US); Lucas Arthur Benson, Camp Hill, PA (US)

(73) Assignee: TE CONNECTIVITY SERVICES GmbH, Schaffhausen (CH)

( * ) Notice: Subject to any disclaimer, the term of this patent is extended or adjusted under 35 U.S.C. 154(b) by 0 days.

(21) Appl. No.: 16/822,489

(22) Filed: Mar. 18, 2020

(65) Prior Publication Data

US 2021/0296818 A1 Sep. 23, 2021

(51) Int. Cl.

| | |
|---|---|
| ***H01R 13/627*** | (2006.01) |
| ***H01R 13/633*** | (2006.01) |
| ***H01R 13/6591*** | (2011.01) |
| ***H01R 13/66*** | (2006.01) |

(52) U.S. Cl.

CPC ..... *H01R 13/6271* (2013.01); *H01R 13/6335* (2013.01); *H01R 13/6591* (2013.01); *H01R 13/6691* (2013.01); *H01R 2201/04* (2013.01)

(58) Field of Classification Search

CPC .. H01R 13/6582–6584; H01R 13/6596; H01R 13/6271; H01R 13/6335; H01R 13/6591; H01R 13/6691; H01R 2201/04

USPC ..... 439/607.17–607.21, 607.28–607.3

See application file for complete search history.

(56) References Cited

U.S. PATENT DOCUMENTS

| | | | | |
|---|---|---|---|---|
| 6,739,759 | B1 * | 5/2004 | Seeley | G02B 6/3849 385/60 |
| 8,714,839 | B2 * | 5/2014 | Ito | H05K 9/0058 385/92 |
| 9,011,177 | B2 | 4/2015 | Lloyd et al. | |
| 9,705,258 | B2 | 7/2017 | Phillips et al. | |
| 10,114,182 | B2 * | 10/2018 | Zbinden | G02B 6/4268 |
| 10,476,198 | B1 * | 11/2019 | Pogash | H01R 13/518 |
| 10,873,160 | B2 * | 12/2020 | Henry | H01R 13/6658 |
| 10,873,161 | B2 * | 12/2020 | Henry | H01R 13/633 |
| 2014/0286613 | A1 * | 9/2014 | Ito | H05K 9/0058 385/88 |
| 2018/0212385 | A1 * | 7/2018 | Little | H01R 31/065 |
| 2019/0027882 | A1 * | 1/2019 | Wang | H01R 13/6456 |
| 2020/0274295 | A1 * | 8/2020 | Briant | G02B 6/4292 |
| 2020/0358227 | A1 * | 11/2020 | Henry | H01R 13/6592 |

* cited by examiner

*Primary Examiner* — Gary F Paumen

(57) ABSTRACT

A communication system includes a plug module having a plug housing and a plug latch and a receptacle module having a receptacle housing and a receptacle latch. The receptacle module includes a receptacle connector with a card slot receiving a plug module circuit board. The receptacle connector includes cables terminated to contacts and extending from the receptacle connector. A receptacle cage includes a front cage interface receiving the plug module and a rear cage interface receiving the receptacle module. The front cage interface matches the rear cage interface including a front latching feature and a rear latching feature interfacing with the plug and receptacle latches.

27 Claims, 11 Drawing Sheets

RECEPTACLE MODULE AND RECEPTACLE CAGE FOR A COMMUNICATION SYSTEM

BACKGROUND OF THE INVENTION

The subject matter herein relates generally to communication systems.

Some communication systems utilize transceivers or plug modules as I/O modules for data communication. The plug module is pluggably received in a receptacle cage of a receptacle assembly to interconnect the plug module with another component, such as a host circuit board through a communication connector mounted to the host circuit board. Due to the high speed of data transmission and the length of the traces on the host circuit board between the communication connector and other components mounted to the host circuit board, some known communication systems bypass data transmission on the host circuit board using a cable receptacle connector. The cable receptacle connector may be received in the rear end of the receptacle cage and the plug module is mated directly to the cable receptacle connector. However, the cable receptacle connector tends to be bulky and require mounting features for mounting the cable receptacle connector to the receptacle cage. The mounting features widen the connector interface and occupy space adjacent the receptacle cage, which increases the footprints of the receptacle cages and the cable receptacle connectors on the host circuit board and limits the number of receptacle cages and cable receptacle connectors that may fit within a particular area.

A need remains for a communication system having a reduced footprint for mating pluggable modules.

BRIEF DESCRIPTION OF THE INVENTION

In one embodiment, a communication system is provided. The communication system includes a plug module having a plug housing. The plug housing has conductive plug housing walls defining a plug module cavity. The plug housing walls include a top wall, a bottom wall and sidewalls between the top wall and the bottom wall. The plug module includes a plug latch coupled to the plug housing. The plug latch includes a plug latching feature and a plug release tab. The plug module includes a plug module circuit board held by the plug housing in the plug module cavity. The plug module circuit board has a mating edge. The plug module includes cables terminated to the plug module circuit board. The communication system includes a receptacle module including a receptacle housing having conductive receptacle housing walls defining a receptacle module cavity. The receptacle housing walls include a top wall, a bottom wall and sidewalls between the top wall and the bottom wall. The receptacle module includes a receptacle latch coupled to the receptacle housing. The receptacle latch includes a receptacle latching feature and a receptacle release tab. The receptacle module includes a receptacle connector received in the receptacle housing. The receptacle connector includes a receptacle connector housing extending forward of the receptacle housing. The receptacle connector housing is manufactured from a dielectric material. The receptacle connector housing has a card slot at a front of the receptacle connector housing receiving the mating edge of the plug module circuit board to electrically connect the plug module to the receptacle module. The receptacle connector includes contacts held by the receptacle connector housing configured to be mated with the plug module circuit board. The receptacle connector includes cables terminated to the contacts and extends rearward from the receptacle connector and the receptacle housing. The communication system includes a receptacle cage having cage walls defining a module channel. The module channel extends between a front end and a rear end of the receptacle cage. The cage walls include a top wall, a bottom wall, and sidewalls extending between the top wall and the bottom wall. The receptacle cage has a front cage interface receiving the plug module at the front end and the receptacle cage has a rear cage interface receiving the receptacle module at the rear end. The front cage interface matches the rear cage interface. The receptacle cage includes a front latching feature interfacing with the plug latch for latchably securing the plug module in the receptacle cage. The receptacle cage includes a rear latching feature interfacing with the receptacle latch for latchably securing the receptacle module in the receptacle cage.

In a further embodiment, a communication system is provided. The communication system includes a plug module including a plug housing having conductive plug housing walls defining a plug module cavity. The plug housing walls include a top wall, a bottom wall and sidewalls between the top wall and the bottom wall. The plug module includes a plug latch coupled to the plug housing. The plug module includes a plug module circuit board held by the plug housing in the plug module cavity. The plug module circuit board has a mating edge. The communication system includes a receptacle module including a receptacle housing having conductive receptacle housing walls defining a receptacle module cavity. The receptacle housing walls include a top wall, a bottom wall and sidewalls between the top wall and the bottom wall. The receptacle module includes a receptacle latch coupled to the receptacle housing. The receptacle module includes a receptacle connector received in the receptacle housing. The receptacle connector includes a receptacle connector housing extending forward of the receptacle housing. The receptacle connector housing is manufactured from a dielectric material. The receptacle connector housing has a card slot at a front of the receptacle connector housing receiving the mating edge of the plug module circuit board to electrically connect the plug module to the receptacle module. The receptacle connector includes contacts held by the receptacle connector housing configured to be mated with the plug module circuit board. The receptacle connector includes cables terminated to the contacts and extends rearward from the receptacle connector and the receptacle housing. The communication system includes a receptacle cage having cage walls defining a module channel. The module channel extends between a front end and a rear end of the receptacle cage. The cage walls includes a top wall, a bottom wall, and sidewalls extending between the top wall and the bottom wall. The top wall, the bottom wall and the sidewalls are continuous between the front end and the rear end to enclose the module channel between the front end and the rear end. The receptacle cage receives the plug module at the front end and receives the receptacle module at the rear end. The receptacle cage has a cage mounting tab extending from at least one of the cage walls for mounting the receptacle cage to a support structure.

In another embodiment, a receptacle module is provided. The receptacle module is configured to be plugged into a receptacle cage of receptacle assembly for mating with a plug module plugged into the receptacle cage. The receptacle module includes a receptacle housing having conductive housing walls defining a receptacle module cavity. The housing walls includes a top wall, a bottom wall and sidewalls between the top wall and the bottom wall. A receptacle latch is coupled to the receptacle housing. The receptacle latch includes a receptacle latching feature configured to engage a cage latching feature of the receptacle cage from inside the receptacle cage to secure the receptacle housing in the receptacle cage. The receptacle latch includes a release tab to release the receptacle latching feature from the cage latching feature. A receptacle connector is received in the receptacle housing. The receptacle connector includes a receptacle connector housing extending forward of the receptacle housing. The receptacle connector housing is manufactured from a dielectric material. The receptacle connector housing has a card slot at a front of the receptacle connector housing configured to receive a plug module circuit board of the plug module. The receptacle connector includes contacts held by the receptacle connector housing configured to be mated with the plug module circuit board. The receptacle connector includes cables terminated to the contacts and extends rearward from the receptacle connector and the receptacle housing.

In a further embodiment, a receptacle cage for mating a plug module and a receptacle module is provided. The receptacle cage includes cage walls defining a module channel. The module channel extends between a front end and a rear end of the receptacle cage. The cage walls includes a top wall, a bottom wall, and sidewalls extending between the top wall and the bottom wall. The top wall, the bottom wall and the sidewalls are continuous between the front end and the rear end to enclose the module channel between the front end and the rear end. A front cage interface is defined by the top wall, the bottom wall and the side walls. The front cage interface has a front port at the front end open to the module channel. The front cage interface includes a front latching feature. A rear cage interface is defined by the top wall, the bottom wall and the side walls. The rear cage interface has a rear port at the rear end open to the module channel. The rear cage interface includes a rear latching feature. The front cage interface matches the rear cage interface such that the front cage interface is configured to receive either of the plug module or the receptacle module with the front latching feature securing the plug module or the receptacle module in the module channel. The rear cage interface is configured to receive the other of the plug module or the receptacle module with the rear latching feature securing the plug module or the receptacle module in the module channel.

DETAILED DESCRIPTION OF THE INVENTION

Figure 1:
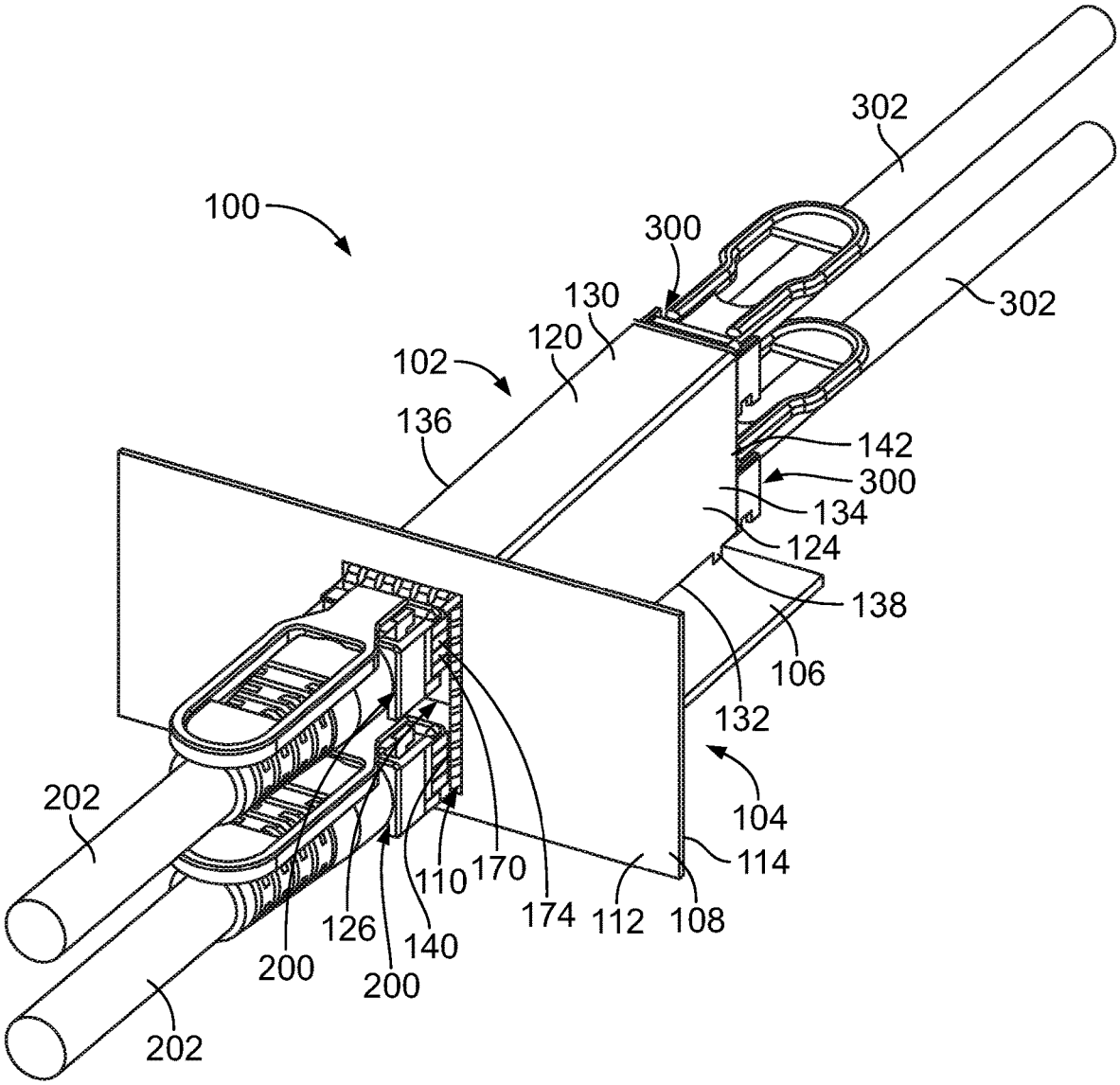
FIG. 1 is a top perspective view of a communication system formed in accordance with an exemplary embodiment.
Figure 2:
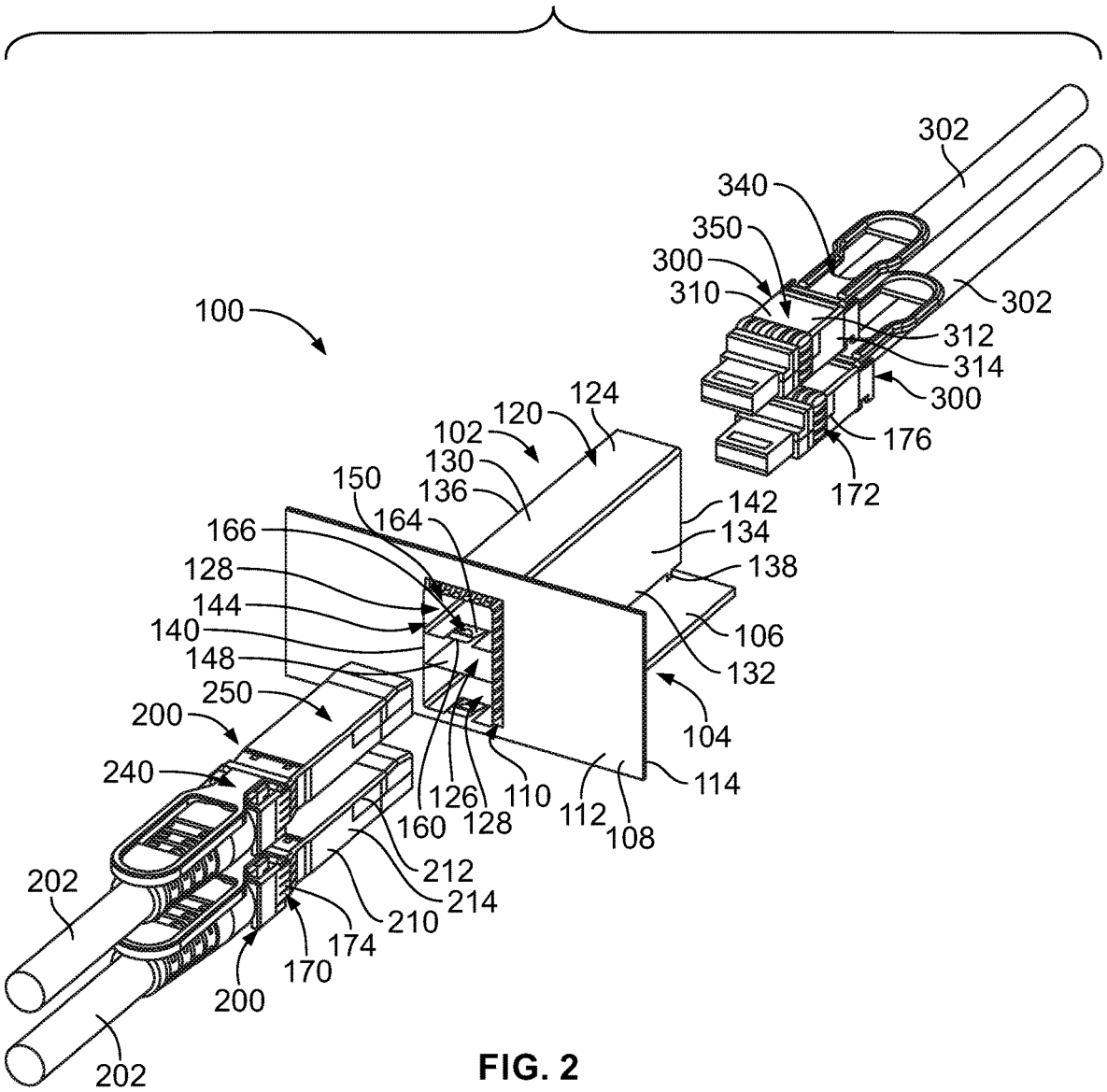
FIG. 2 is an exploded, front perspective view of the communication system in accordance with an exemplary embodiment.
Figure 3:
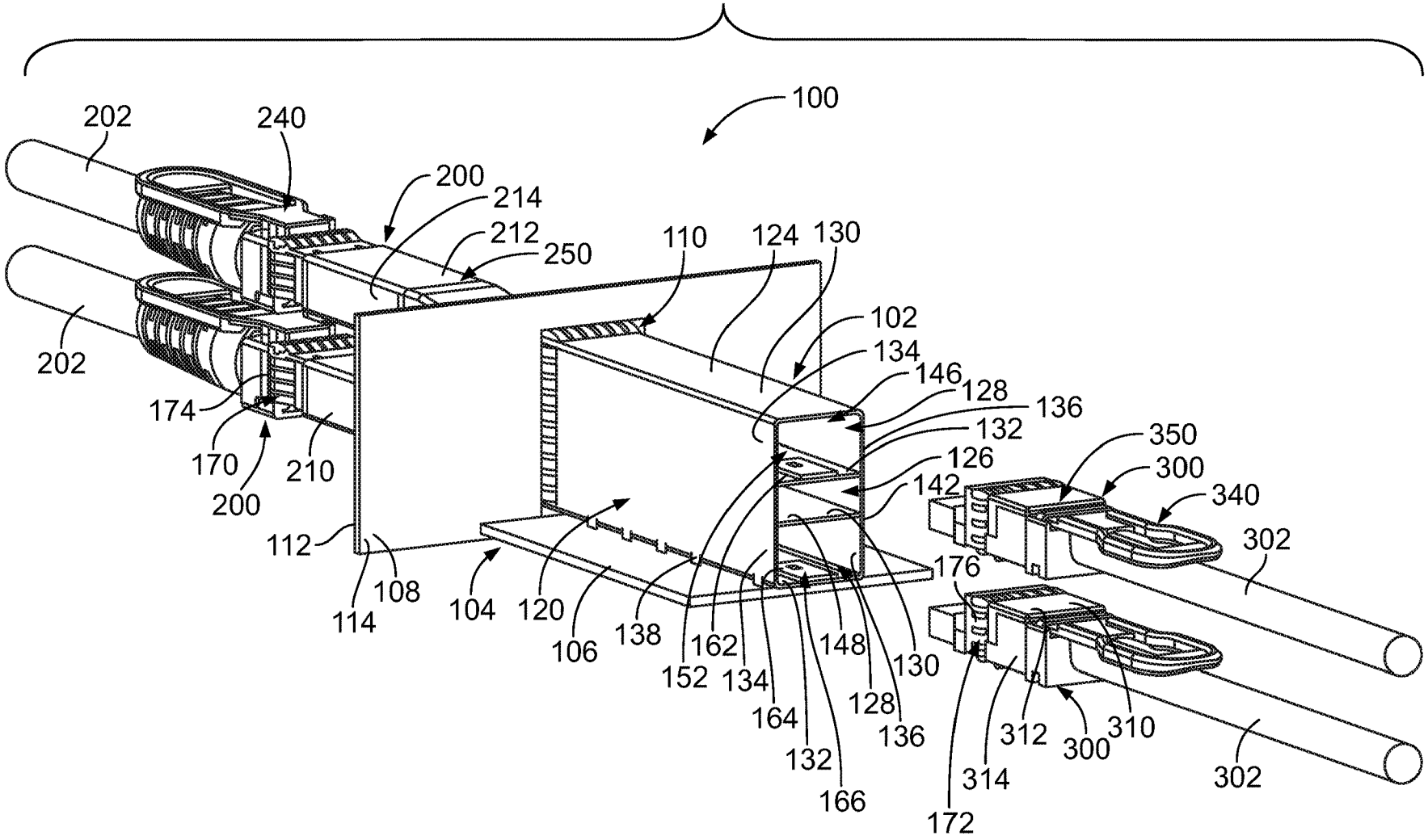
FIG. 3 is an exploded, rear perspective view of the communication system in accordance with an exemplary embodiment.

FIG. 1 is a top perspective view of a communication system 100 formed in accordance with an exemplary embodiment. FIG. 2 is an exploded, front perspective view of the communication system 100 in accordance with an exemplary embodiment. FIG. 3 is an exploded, rear perspective view of the communication system 100 in accordance with an exemplary embodiment.

The communication system 100 includes a receptacle connector assembly 102 and one or more plug modules 200 configured to be electrically connected to the receptacle connector assembly 102. The receptacle connector assembly 102 includes one or more receptacle modules 300 configured to be electrically connected to corresponding plug modules 200. In an exemplary embodiment, each plug module 200 is electrically connected to one or more cables 202 and each receptacle module 300 is electrically connected to one or more cables 302. The plug module 200 is pluggably coupled to the corresponding receptacle module 300 at a separable mating interface.

In an exemplary embodiment, the receptacle connector assembly 102 is mounted to a support structure 104. For example, in the illustrated embodiment, the support structure 104 may include a circuit board 106. The receptacle connector assembly 102 is mounted to the circuit board 106. In an exemplary embodiment, neither the plug module 200 nor the receptacle module 300 is electrically connected to the circuit board 106. Rather, the plug module 200 and the receptacle module 300 are electrically connected to other electrical components via the cables 202, 302 rather than through traces on the circuit board 106. The circuit board 106 may provide a ground reference for the receptacle connector assembly 102.

In an exemplary embodiment, the support structure 104 may additionally, or alternatively, include a panel 108. The panel 108 may be a rack panel in a server in various embodiments. In other various embodiments, the panel 108 may include a cabinet or chassis of an electrical device, such as a computer. The panel 108 may be another type of support structure in alternative embodiments. The panel 108 may be a metal plate or sheet in various embodiments. In an exemplary embodiment, the panel 108 is oriented perpendicular to the mating direction of the modules 200, 300. The panel 108 includes a panel opening 110 therethrough. The panel opening 110 is open between a front surface 112 and a rear surface of the panel 108. A portion of the receptacle connector assembly 102 extends through the panel opening 110 such that a front of the receptacle connector assembly 102 is flush with or forward of the front surface 112 and a rear of the receptacle connector assembly 102 is flush with or rearward of the rear surface 114. The receptacle connector assembly 102 may be mounted directly to the panel 108, such as to the rear surface 114 and/or the front surface 112.

The panel 108 may have other orientations in alternative embodiments, such as being parallel to the mating direction of the modules 200, 300. A side of the receptacle connector assembly 102 may be coupled to the panel 108 in such orientation. In various embodiments, the receptacle connector assembly 102 may be free standing from the panel 108 (for example, mounted to the panel 108) without the circuit board 106.

In an exemplary embodiment, the receptacle connector assembly 102 includes a receptacle cage 120. The receptacle module 300 is configured to be loaded into a rear of the receptacle cage 120. The plug module 200 is configured to be loaded into a front of the receptacle cage 120. The plug module 200 is mated to the receptacle module 300 inside the receptacle cage 120. In various embodiments, the receptacle cage 120 is enclosed and provides electrical shielding for the receptacle module 300 and the plug module 200. The receptacle cage 120 provides shielding for the receptacle module 300 and the plug module 200.

The receptacle cage 120 includes a plurality of cage walls 124 that define a cavity 126. The cavity 126 may be subdivided by corresponding cage walls 124 to form one or more module channels 128 for receipt of corresponding plug modules 200 and receptacle modules 300. In the illustrated embodiment, the cavity 126 is divided into two module channels 128, however, additional cage walls 124 may be provided to form a cavity 126 divided into more module channels, such as four module channels 128 or more. The cage walls 124 may be walls defined by solid sheets, perforated walls to allow airflow therethrough, or walls with cutouts, such as for a heat transfer device such as a heatsink, heat spreader, cold plate, and the like to pass therethrough. In the illustrated embodiment, the cage walls 124 are stamped and formed walls defining shielding walls.

In the illustrated embodiment, the receptacle cage 120 includes multiple module channels 128 for receiving multiple plug modules 200 and receptacle modules 300. The module channels 128 are stacked vertically to define an upper module channel 128 and a lower module channel 128. The module channels 128 may be stacked side-by-side in alternative embodiments. The receptacle cage 120 includes front ports open at the front of the receptacle cage 120 to receive the plug modules 200 and rear ports open at the rear of the receptacle cage 120 to receive the receptacle modules 300. Any number of module channels 128 may be provided in various embodiments. For example, the receptacle cage 120 may include both ganged and stacked module channels 128 (for example, 2×2, 3×2, 4×2, 4×3, etc.). In other various embodiments, rather than being a ganged or stacked cage member, the receptacle cage 120 may include a single module channel 128.

In an exemplary embodiment, the cage walls 124 of the receptacle cage 120 include a top wall 130, a bottom wall 132, a first side wall 134, and a second side wall 136 for each module channel 128. Such cage walls 124 may define a top wall, a bottom wall, a first side wall, and a second side wall of the receptacle cage 120 when such walls 130, 132, 134, 136 are the outer or exterior walls. The bottom wall 132 may rest on the circuit board 106 when the circuit board 106 is provided. In an exemplary embodiment, the cage walls 124 include cage mounting tabs 138 for mounting the receptacle cage 120 to the circuit board 106. For example, the cage mounting tabs 138 may be press-fit pins configured to be press-fit into vias in the circuit board 106. Other types of cage mounting tabs 138 may be used in alternative embodiments. For example, the cage mounting tabs 138 may be coupled to the panel 108. However, in alternative embodiments, the receptacle cage 120 may stand alone separate from any circuit board, such as being mounted to the panel 108 without any circuit board 106 present.

The receptacle cage 120 extends between a front end 140 and a rear end 142. Front ports 144 are provided at the front end 140 providing access to the corresponding module channels 128 for the plug modules 200. Rear ports 146 are provided at the rear end 142 providing access to the corresponding module channels 128 for the receptacle modules 300. Some of the cage walls 124 may be interior cage walls that separate or divide the cavity 126 into the various module channels 128. For example, the cage walls 124 may include a divider 148 separating the module channels 128 (for example, a horizontal divider or a vertical divider). The divider 148 may define the top wall 130, the bottom wall 132, the first side wall 134, or the second side wall 136 of one or more of the module channels 128.

The walls 130, 132, 134, 136 form rectangular shaped module channels 128 in an exemplary embodiment extending along a longitudinal axis. The module channels 128 may extend the entire length between the front end 140 and the rear end 142. The receptacle cage 120 includes a front cage interface 150 at the front end 140 and a rear cage interface 152 at the rear end 142. The front cage interface 150 interfaces with the plug module 200. The rear cage interface 152 interfaces with the receptacle module 300. The front cage interface 150 is defined by an interior surface of the receptacle cage 120. The rear cage interface 152 is defined by an interior surface of the receptacle cage 120. In an exemplary embodiment, the front cage interface 150 is defined as the front quartile of the receptacle cage 120, including all features of the receptacle cage 120 interfacing with the plug module 200 and the rear cage interface 152 is defined as the rear quartile of the receptacle cage 120, including all features of the receptacle cage 120 interfacing with the receptacle module 300.

The front cage interface 150 is defined by the top wall 130, the bottom wall 132, the first side wall 134, and the second side wall 136 at the front end 140. For example, the front cage interface 150 may have a channel envelope (for example, size and shape) defined by the top wall 130, the bottom wall 132, the first side wall 134, and the second side wall 136 at the front end 140. The rear cage interface 152 is defined by the top wall 130, the bottom wall 132, the first side wall 134, and the second side wall 136 at the rear end 142. For example, the rear cage interface 152 may have a channel envelope (for example, size and shape) defined by the top wall 130, the bottom wall 132, the first side wall 134, and the second side wall 136 at the rear end 142. In an exemplary embodiment, the front cage interface 150 matches the rear cage interface 152. For example, the front cage interface 150 is identical to the rear cage interface 150. The front cage interface 150 may have the same size and the same shape as the rear cage interface 150. As such, either the plug module 200 or the rear module 300 may be plugged into and interface with the front cage interface 150 and such that either the plug module 200 or the rear module 300 may be plugged into and interface with the rear cage interface 152.

In an exemplary embodiment, the receptacle cage 120 includes a front latching feature 160 (FIG. 2) for each module channel 128 and a rear latching feature 162 (FIG. 3) for each module channel 128. The front latching feature 160 is provided proximate to the front end 140. The rear latching feature 162 is provided proximate to the rear end 142. The front latching feature 160 forms part of the front cage interface 150 configured to interface with the plug module 200. The rear latching feature 162 forms part of the rear cage interface 152 configured to interface with the receptacle module 300. The front latching feature 160 is used to secure the plug module 200 in the module channel 128. The front latching feature 160 is accessible and engaged by the plug module 200 from inside the module channel 128. The rear latching feature 162 is used to secure the receptacle module 300 in the module channel 128. The rear latching feature 162 is accessible and engaged by the receptacle module 300 from inside the module channel 128. The front latching feature 160 may be identical to the rear latching feature 162.

In various embodiments, the latching features 160, 162 are deflectable latches 164 having openings 166. The deflectable latches 164 may extend from one or more of the cage walls 124. For example, in the illustrated embodiment, the latching features 160, 162 extend from the bottom walls 132 below each of the module channels 128 to engage the bottoms of the plug module 200 and the receptacle module 300, respectively. The latching features 160, 162 may extend from other cage walls 124, such as the sidewalls 134, 136 or the top walls 130. The latching features 160, 162 may be released, such as by pulling on release tabs of the modules 200, 300 to release the latches 164 from the modules 200, 300. In other various embodiments, the latching features 160, 162 may be openings in the cage walls 124 configured to receive deflectable latches of the modules 200, 300. For example, hook ends of latches of the modules 200, 300 may be received in openings in the bottom wall 132 defining the latching features 160, 162.

In an exemplary embodiment, the receptacle cage 120 includes a front EMI gasket 170 providing EMI shielding at the front end 140 and a rear EMI gasket 172 providing EMI shielding at the rear end 142. The front EMI gasket 170 provides EMI shielding between the cage walls 124 and the plug module 200. The module channel 128 is enclosed by the front and rear EMI gaskets 170, 172 at the front and rear ends 140, 142 to prevent EMI leakage along the cage walls 124 or along the modules 200, 300.

In the illustrated embodiment, the front EMI gasket 170 is coupled to the plug module 200 and loaded into the module channel 128 with the plug module 200. The EMI gasket 170 includes gasket fingers 174 deflectable between the exterior surfaces of the plug module 200 and the interior surfaces of the cage walls 124. The gasket fingers 174 may be extend between the plug module 200 and any or all of the walls 130, 132, 134, 136. In an alternative embodiment, the front EMI gasket 170 may be coupled to the cage walls 124 and extend inward into the module channel 128 to engage the plug module 200 when the plug module 200 is plugged into the module channel 128. For example, the front EMI gasket 170 may be separate and discrete from the cage walls 124 and clipped onto or soldered to the cage walls 124. In other various embodiments, the front EMI gasket 170 may be integral with the cage walls 124, such as being stamped and formed from the cage walls 124.

In the illustrated embodiment, the rear EMI gasket 172 is coupled to the plug module 200 and loaded into the module channel 128 with the receptacle module 300. The EMI gasket 172 includes gasket fingers 176 deflectable between the exterior surfaces of the receptacle module 300 and the interior surfaces of the cage walls 124. The gasket fingers 176 may be extend between the receptacle module 300 and any or all of the walls 130, 132, 134, 136. In an alternative embodiment, the rear EMI gasket 172 may be coupled to the cage walls 124 and extend inward into the module channel 128 to engage the receptacle module 300 when the receptacle module 300 is plugged into the module channel 128. For example, the rear EMI gasket 172 may be separate and discrete from the cage walls 124 and clipped onto or soldered to the cage walls 124. In other various embodiments, the rear EMI gasket 172 may be integral with the cage walls 124, such as being stamped and formed from the cage walls 124.

Figure 4:
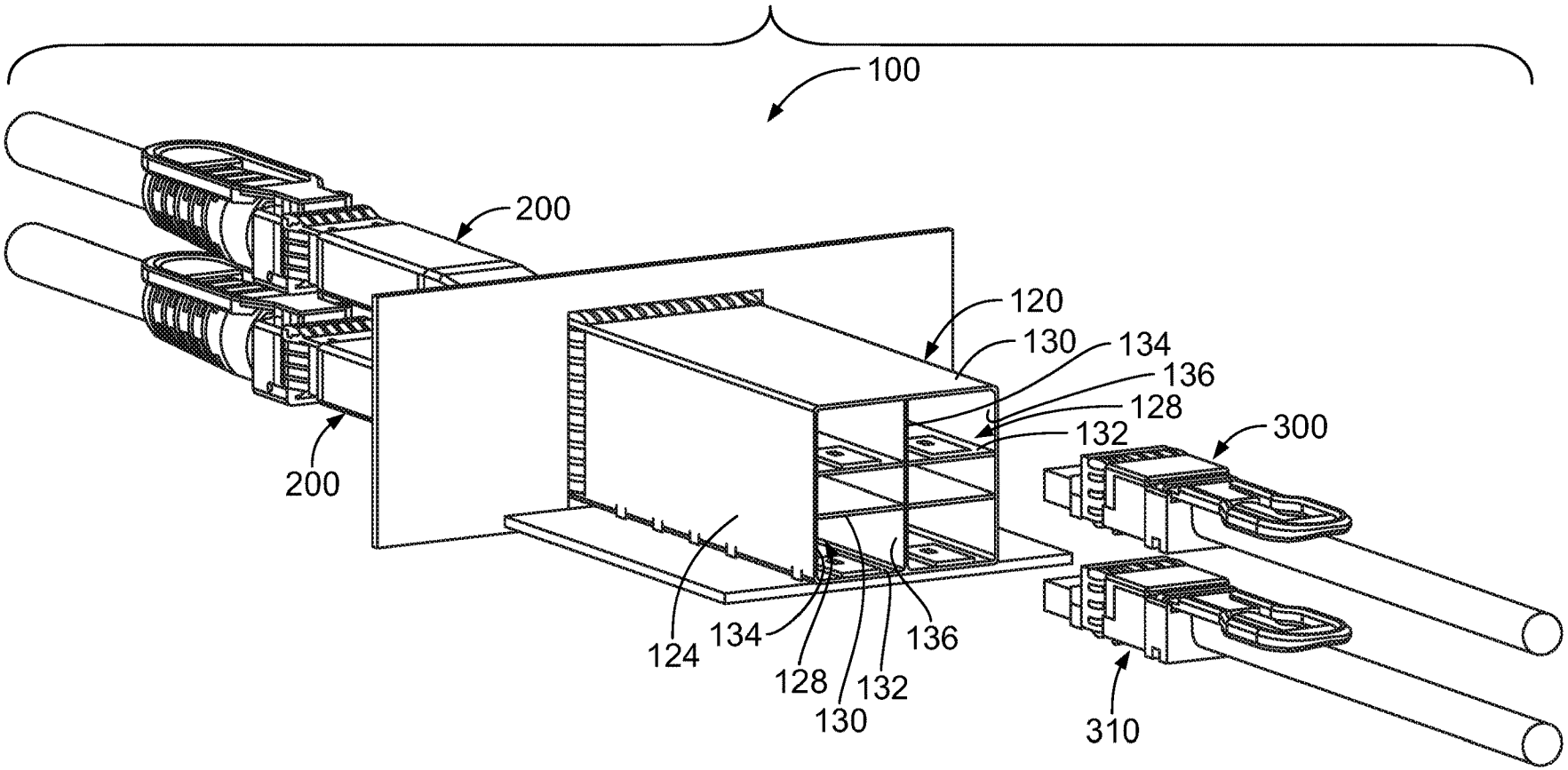
FIG. 4 is a rear perspective view of the communication system in accordance with an exemplary embodiment.

FIG. 4 is a rear perspective view of the communication system 100 in accordance with an exemplary embodiment. The receptacle cage 120 includes four module channels 128 in the illustrated embodiment in a two-by-two arrangement. Each module channel 128 is defined by corresponding top walls 130, bottom walls 132, first sidewalls 134, and second sidewalls 136. The module channels 128 may share cage walls 124. For example, a single cage wall 124 may be arranged between adjacent module channels 128 thus defining a first sidewall 134 for one module channel and a second sidewall 136 for another module channel. In an exemplary embodiment, the module channels 128 are separated by a single piece of sheet metal. The plug modules 200 and the receptacle modules 300 are narrower than the module channels 128 such that the plug modules 200 and the receptacle modules 300 are contained within the channel envelope allowing the module channels 128 to be tightly arranged for increased overall density of the communication system. For example, the receptacle cage 120 may have a small footprint by reducing the spacing between the module channels 128, such as to a single sheet metal thickness.

Figure 5:
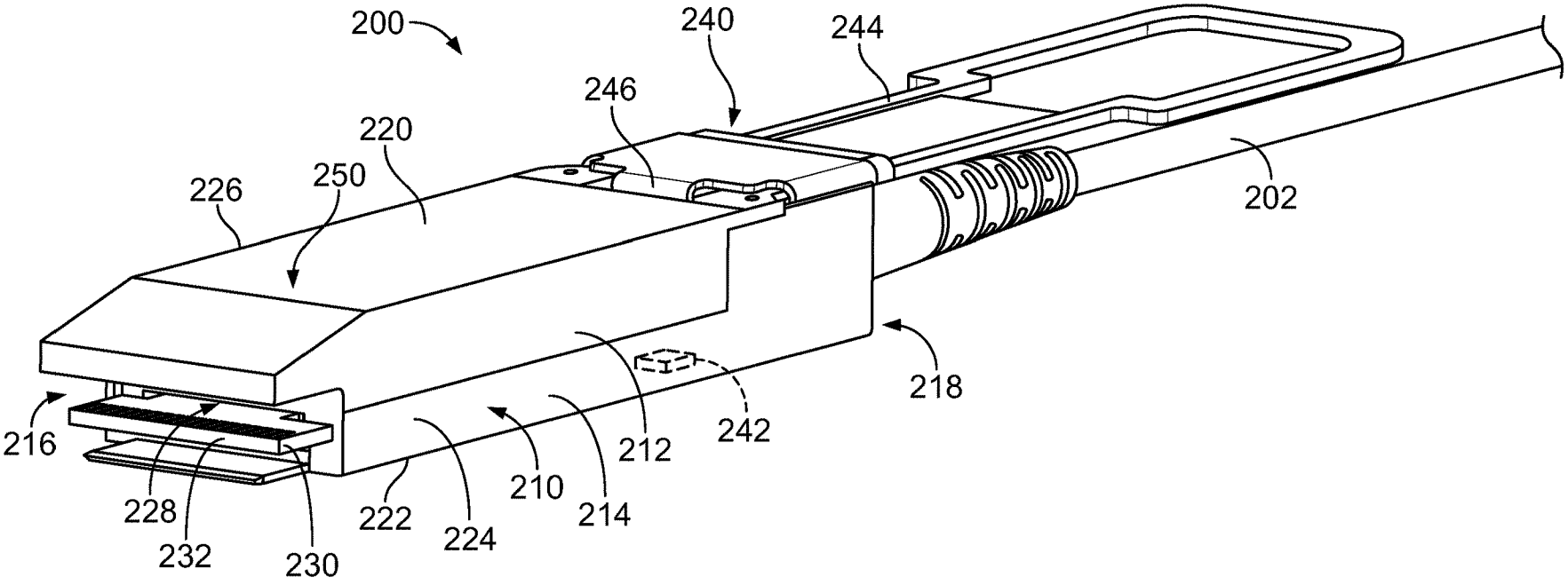
FIG. 5 is a perspective view of the plug module in accordance with an exemplary embodiment.

FIG. 5 is a perspective view of the plug module 200 in accordance with an exemplary embodiment. The plug module 200 includes a plug housing 210 defined by one or more shells, such as an upper shell 212 and a lower shell 214. In an exemplary embodiment, the plug housing 210 is manufactured from a conductive material, such as a metal material. The plug housing 210 provides electrical shielding for the plug module 200. The plug housing 210 may be thermally conductive. The plug housing 210 includes a mating end 216 and an opposite cable end 218. The cable 202 extends from the cable end 218. The mating end 216 is configured to be inserted into the corresponding module channel 128 (shown in FIG. 2). The cable end 218 is configured to extend from the front end 140 of the receptacle cage 120 (shown in FIG. 2) when the plug module 200 is plugged into the receptacle cage 120.

The plug housing 210 includes a top wall 220, a bottom wall 222, a first side wall 224 extending between the top wall 220 and the bottom wall 222, and a second side wall 226 extending between the top wall 220 and the bottom wall 222. The top wall 220 is part of the upper shell 212 and the bottom wall 222 is part of the lower shell 214. The first side wall 224 may be defined by the upper shell 212 and/or the lower shell 214. The second side wall 226 may be defined by the upper shell 212 and/or the lower shell 214. For example, in an exemplary embodiment, the upper and lower shells 212, 214 meet at an interface approximate centered along the side walls 224, 226. The plug housing 210 surrounds a plug module cavity 228. The plug module cavity 228 houses electrical components of the plug module 200. The cables 202 may extend into the plug module cavity 228 for termination to the electrical components.

In an exemplary embodiment, the plug module 200 includes a plug module circuit board 230 in the plug module cavity 228. The plug module circuit board 230 may be accessible at the mating end 216. The plug module circuit board 230 is configured to be communicatively coupled to the receptacle module 300 (shown in FIG. 3). For example, a mating edge 232 of the plug module circuit board 230 may be plugged into the receptacle module 300, such as in a card slot of the receptacle module 300. The plug module circuit board 230 includes electrical components used for operating and/or using the plug module 200. For example, the plug module circuit board 230 may have conductors, traces, pads, electronics, sensors, controllers, switches, inputs, outputs, and the like to form various circuits.

The plug module 200 includes a plug latch 240 for releasing the plug module 200 from the receptacle cage 120. The plug latch 240 includes a plug latching feature 242 (shown in phantom) configured to secure the plug module 200 to the receptacle cage 120. For example, the plug latching feature 242 is configured to interface with the front latching feature 160 (shown in FIG. 2) of the receptacle cage 120. The plug latching feature 242 may be a latching finger. The plug latching feature 242 may be deflectable in various embodiments, such as to release from the receptacle cage 120.

In an exemplary embodiment, the plug latch 240 includes a pull tab 244 extending from one or more latch arms 246. The pull tab 244 is configured to be pulled to release the plug latch 240 from the receptacle cage 120 and allow removal of the plug module 200 from the receptacle cage 120. The latch arm 246 may be used to release the plug latching feature 242 from the front latching feature 160. For example, the latch arm 246 may actuate the plug latching feature 242 and/or the front latching feature 160 to deflect such plug latching feature 242 or the front latching feature 160 and allow the plug latching feature 242 to release from the front latching feature 160. The latch arm 246 may slide or rotate to an actuating position to release the plug latching feature 242 and/or the front latching feature 160. The latch arm 246 is moved by pulling on the pull tab 244.

The plug housing 210 includes a plug mating interface 250 configured to interface with the front cage interface 150 (shown in FIG. 2) of the receptacle cage 120. The plug mating interface 250 is defined by an exterior surface of the plug housing 210. In an exemplary embodiment, the plug mating interface 250 is defined by the top wall 220, the bottom wall 222, the first side wall 224, and the second side wall 226, such as at the mating end 216. The plug mating interface 250 may be defined along the entire length of the plug housing 210 that is received in the receptacle cage 120. For example, the plug mating interface 250 may extend a majority of the length of the plug housing 210.

Figure 6:
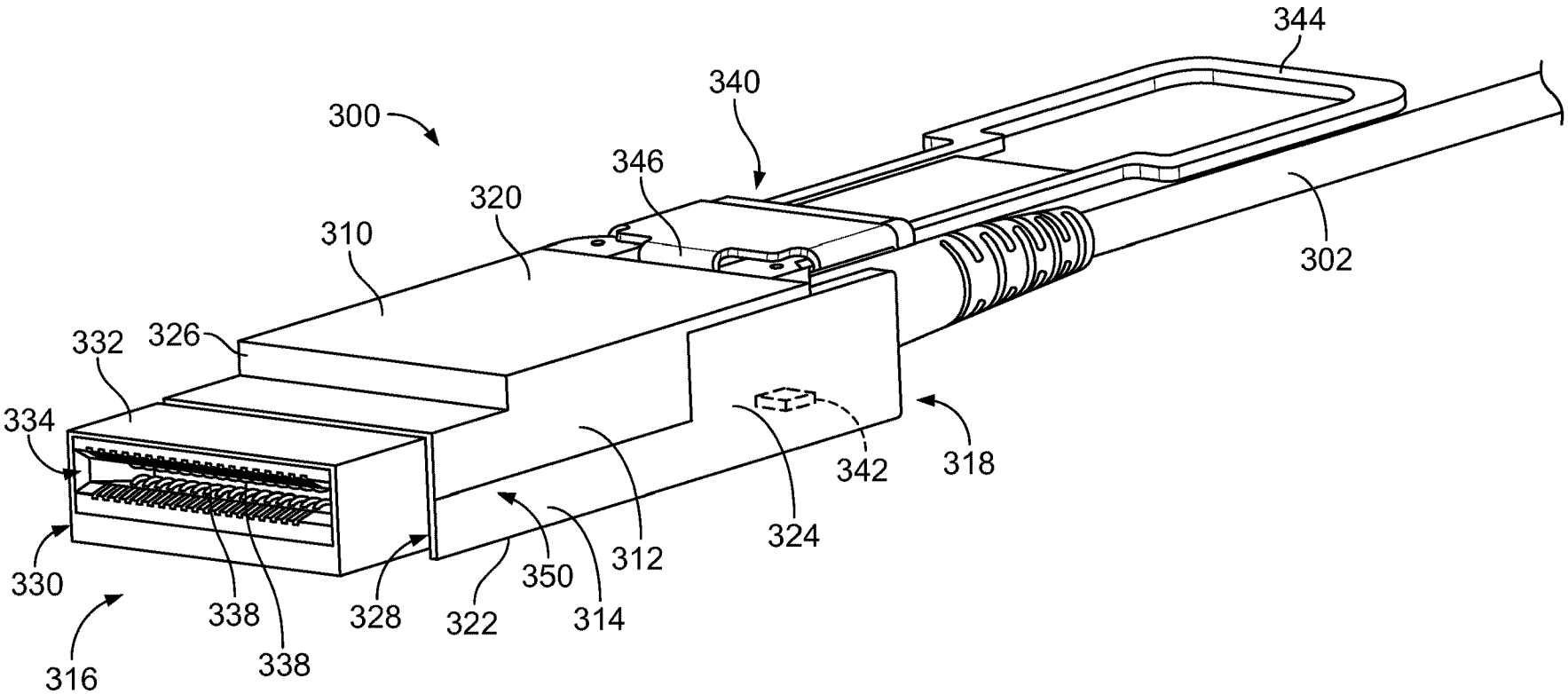
FIG. 6 is a perspective view of the receptacle module in accordance with an exemplary embodiment.
Figure 7:
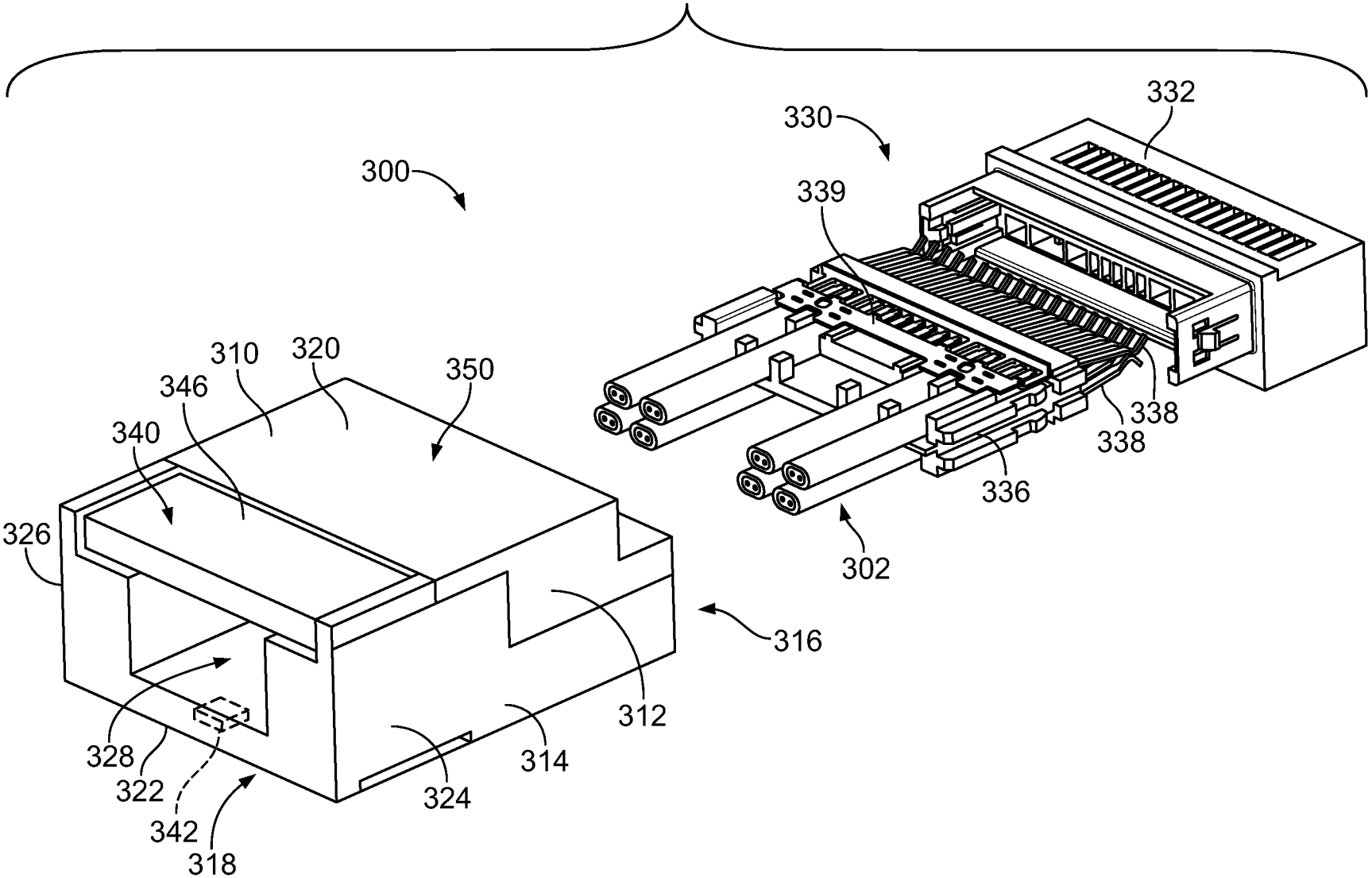
FIG. 7 is a rear, exploded view of the receptacle module in accordance with an exemplary embodiment.

FIG. 6 is a perspective view of the receptacle module 300 in accordance with an exemplary embodiment. FIG. 7 is a rear, exploded view of the receptacle module 300 in accordance with an exemplary embodiment. The receptacle module 300 includes a receptacle housing 310 defined by one or more shells, such as an upper shell 312 and a lower shell 314. In an exemplary embodiment, the receptacle housing 310 is manufactured from a conductive material, such as a metal material. The receptacle housing 310 provides electrical shielding for the receptacle module 300. The receptacle housing 310 may be thermally conductive. The receptacle housing 310 includes a mating end 316 and an opposite cable end 318. The cable 302 extends from the cable end 318. The mating end 316 is configured to be inserted into the corresponding module channel 128 (shown in FIG. 3). The cable end 318 is configured to extend from the rear end 142 of the receptacle cage 120 (shown in FIG. 3) when the receptacle module 300 is plugged into the receptacle cage 120.

The receptacle housing 310 includes a top wall 320, a bottom wall 322, a first side wall 324 extending between the top wall 320 and the bottom wall 322, and a second side wall 326 extending between the top wall 320 and the bottom wall 322. The top wall 320 is part of the upper shell 312 and the bottom wall 322 is part of the lower shell 314. The first side wall 324 may be defined by the upper shell 312 and/or the lower shell 314. The second side wall 326 may be defined by the upper shell 312 and/or the lower shell 314. For example, in an exemplary embodiment, the upper and lower shells 312, 314 meet at an interface approximate centered along the side walls 324, 326. The receptacle housing 310 surrounds a receptacle module cavity 328. The receptacle module cavity 328 houses electrical components of the receptacle module 300. The cables 302 may extend into the receptacle module cavity 328 for termination to the electrical components.

In an exemplary embodiment, the receptacle module 300 includes a receptacle connector 330 coupled to the mating end 316 of the receptacle housing 310. The receptacle connector 330 includes a receptacle connector housing 332 having a card slot 334 (FIG. 6) configured to receive the plug module circuit board 230 (shown in FIG. 5). The receptacle connector 330 includes a contact holder 336 (FIG. 7) and contacts 338 held by the contact holder 336. The contact holder 336 is manufactured from a dielectric material, such as plastic material. The contacts 338 may be coupled to an upper surface and a lower surface of the contact holder 336 to define an upper contact array for mating with the upper surface of the plug module circuit board 230 and a lower contact array for mating with a lower surface of the plug module circuit board 230. Conductors of the cables 302 may be terminated to the contacts 338, such as being soldered to the contacts 338. A ground shield 339 may be electrically connected to cable shields of the cables 302 and ground contacts of the contacts 338. Mating ends of the contacts 338 are configured to be loaded into the receptacle connector housing 332 for mating with contact pads at the edge of the plug module circuit board 230 loaded into the card slot 334.

The receptacle module 300 includes a receptacle latch 340 for releasing the receptacle module 300 from the receptacle cage 120. The receptacle latch 340 includes a receptacle latching feature 342 (shown in phantom) configured to secure the receptacle module 300 to the receptacle cage 120. For example, the receptacle latching feature 342 is configured to interface with the rear latching feature 162 (shown in FIG. 3) of the receptacle cage 120. The receptacle latching feature 342 may be a latching finger. The receptacle latching feature 342 may be deflectable in various embodiments, such as to release from the receptacle cage 120.

In an exemplary embodiment, the receptacle latch 340 includes a pull tab 344 extending from one or more latch arms 346. The pull tab 344 is configured to be pulled to release the receptacle latch 340 from the receptacle cage 120 and allow removal of the receptacle module 300 from the receptacle cage 120. The latch arm 346 may be used to release the receptacle latching feature 342 from the rear latching feature 162. For example, the latch arm 346 may actuate the receptacle latching feature 342 and/or the rear latching feature 162 to deflect such receptacle latching feature 342 or the rear latching feature 162 and allow the receptacle latching feature 342 to release from the rear latching feature 162. The latch arm 346 may slide or rotate to an actuating position to release the receptacle latching feature 342 and/or the rear latching feature 162. The latch arm 346 is moved by pulling on the pull tab 344.

The receptacle housing 310 includes a receptacle mating interface 350 configured to interface with the rear cage interface 152 (shown in FIG. 3) of the receptacle cage 120. The receptacle mating interface 350 is defined by an exterior surface of the receptacle housing 310. In an exemplary embodiment, the receptacle mating interface 350 is defined by the top wall 320, the bottom wall 322, the first side wall 324, and the second side wall 326, such as at the mating end 316. The receptacle mating interface 350 may be defined along the entire length of the receptacle housing 310 that is received in the receptacle cage 120. For example, the receptacle mating interface 350 may extend a majority of the length of the receptacle housing 310.

Returning to FIGS. 2 and 3, the plug housing 210 and the receptacle housing 310 are configured to be plugged into the receptacle cage 120. In an exemplary embodiment, the receptacle mating interface 350 matches the plug mating interface 250. For example, the receptacle mating interface 350 may have the same size and shape of the plug mating interface 250. The upper and lower shells 312, 314 may have the same exterior perimeter dimensions as the upper and lower shells 212, 214 of the plug housing 210. The front cage interface 150 matches the rear cage interface 152 such that the front cage interface 150 is configured to receive either of the plug module 200 or the receptacle module 300 and the rear cage interface 152 is configured to receive the other of the plug module 200 or the receptacle module 300.

In an exemplary embodiment, the cage interfaces 150, 152 are identical and the mating interfaces 250, 350 are identical such that the plug module 200 and the receptacle module 300 may be interchangeably received in the receptacle cage 120. Both the plug module 200 and the receptacle module 300 are configured to fit within the channel envelope of the module channel 128 of the receptacle cage 120. The plug module 200 and the receptacle module 300 are configured to interface with the receptacle cage 120 from within the interior of the receptacle cage 120. The plug latch 240 and the receptacle latch 340 define portions of the mating interfaces 250, 350, respectively. The plug latch 240 is configured to interface with the front latching feature 160 from within the interior of the receptacle cage 120 to secure the plug module 200 in the module channel 128. The receptacle latch 340 is configured to interface with the rear latching feature 162 from within the interior of the receptacle cage 120 to secure the receptacle module 300 in the module channel 128.

Figure 8:
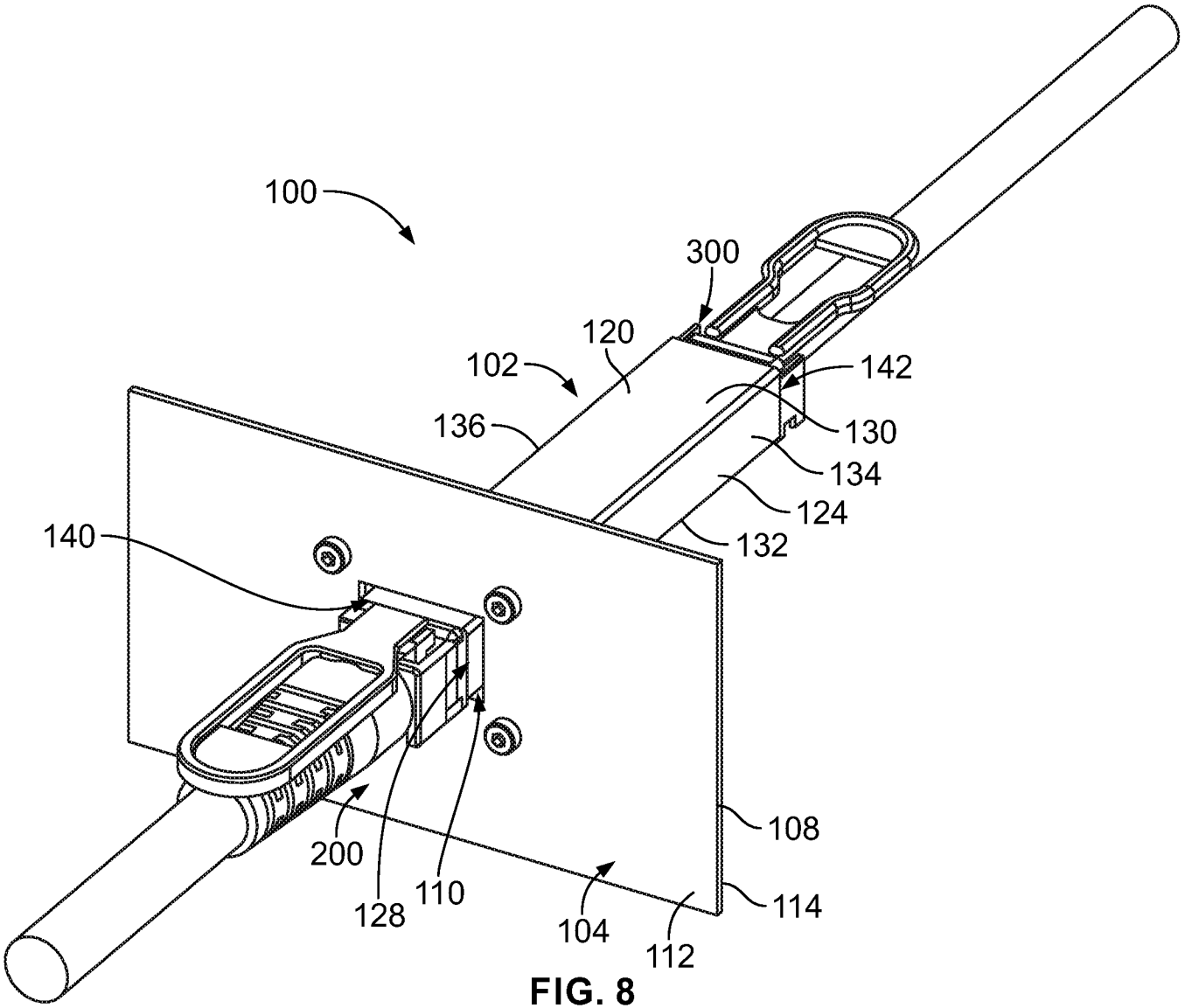
FIG. 8 is a top perspective view of the communication system formed in accordance with an exemplary embodiment.
Figure 9:
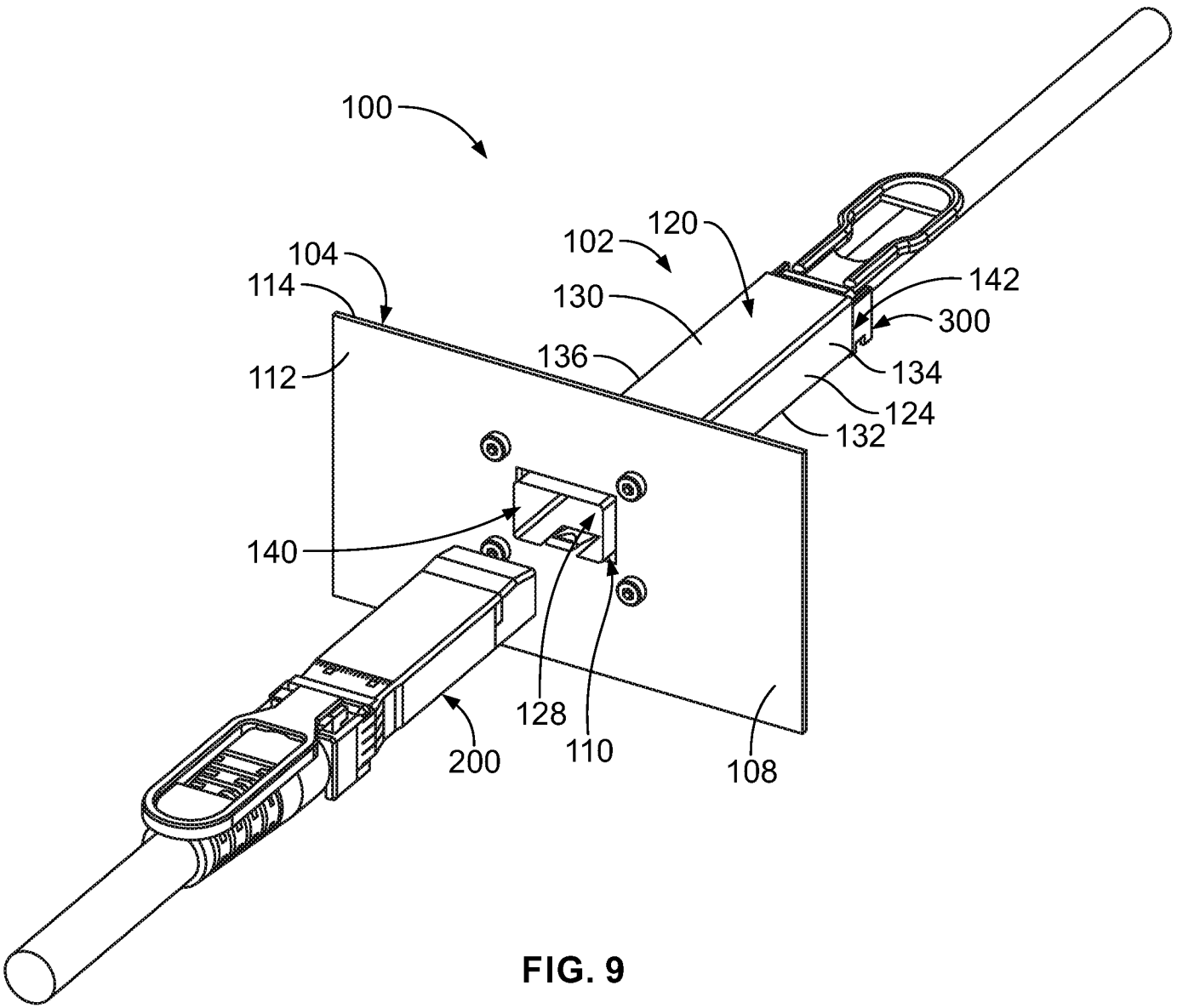
FIG. 9 is an exploded, front perspective view of the communication system in accordance with an exemplary embodiment.
Figure 10:
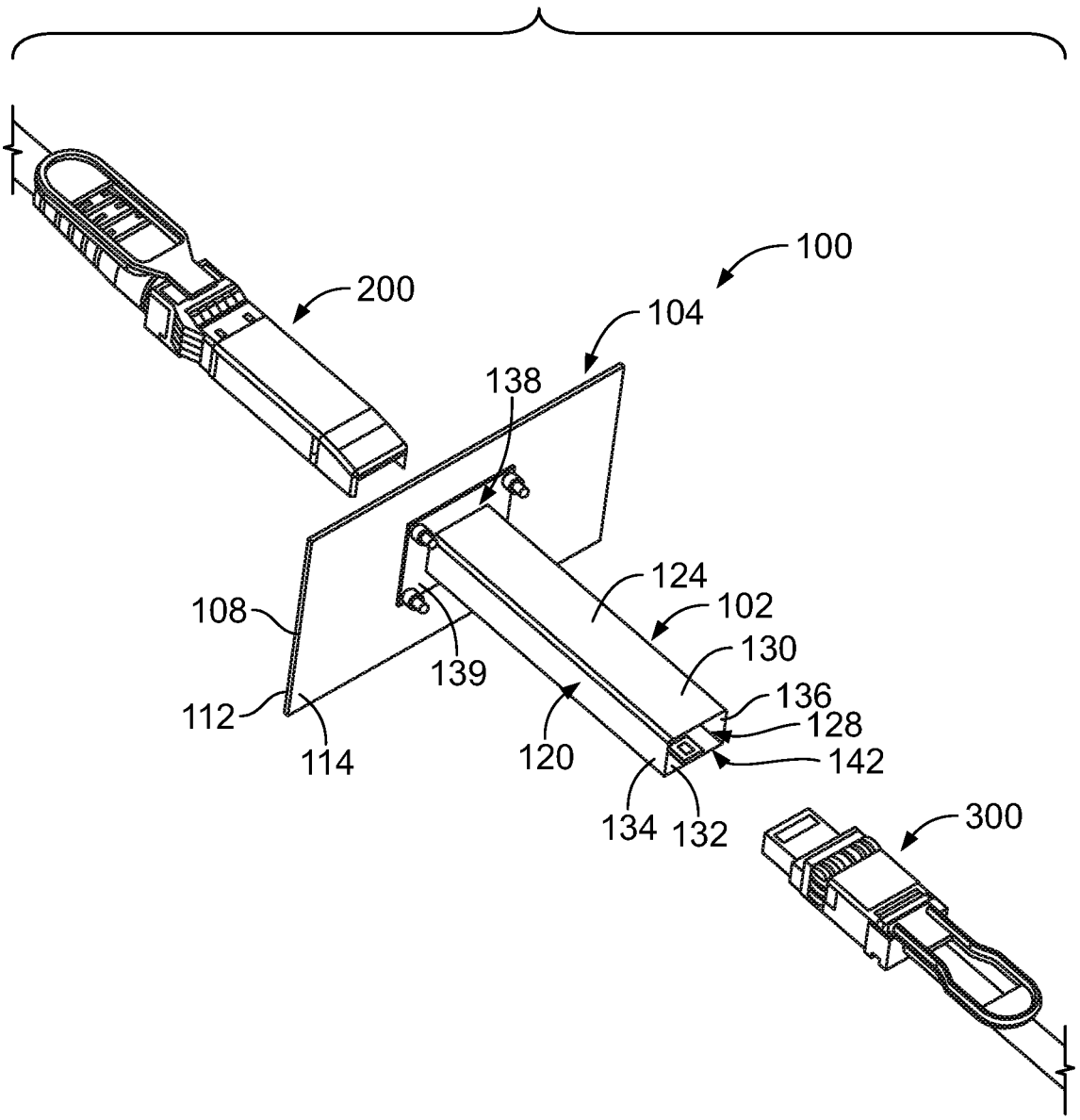
FIG. 10 is an exploded, rear perspective view of the communication system in accordance with an exemplary embodiment.

FIG. 8 is a top perspective view of the communication system 100 formed in accordance with an exemplary embodiment. FIG. 9 is an exploded, front perspective view of the communication system 100 in accordance with an exemplary embodiment. FIG. 10 is an exploded, rear perspective view of the communication system 100 in accordance with an exemplary embodiment. The receptacle cage 120 includes a single module channel 128 in the illustrated embodiment that receives the plug module 200 and the receptacle module 300. The module channel 128 is defined by the top wall 130, the bottom wall 132, the first sidewall 134, and the second sidewall 136, which are each exterior cage walls 124 of the receptacle cage 120.

The receptacle connector assembly 102 is mounted to the support structure 104. In the illustrated embodiment, the support structure 104 is the panel 108. The receptacle connector assembly 102 does not include the circuit board 106 (shown in FIG. 1). The receptacle connector assembly 102 is mounted directly to the panel 108 and free standing from the panel 108 separate from any circuit board. The panel 108 is oriented perpendicular to the longitudinal axis of the module channel 128. The receptacle cage 120 extends through the panel opening 110. The front end 140 of the receptacle cage 120 may be flush with or forward of the front surface 112 of the panel 108 and the rear end 142 of the receptacle cage 120 may be flush with or rearward of the rear surface 114. The receptacle cage 120 may be mounted directly to the panel 108, such as to the rear surface 114 and/or the front surface 112.

The receptacle cage 120 includes the cage mounting tabs 138 for mounting the receptacle cage 120 to the panel 108. For example, in the illustrated embodiment, the cage mounting tabs 138 include flanges 139 extending outward from one or more of the cage walls 124. The flanges 139 may be integral with the cage walls 124, such as being stamped and formed with the cage walls 124. In other various embodiments, the flanges 139 may be separate and discrete from the cage walls 124 and coupled to the cage walls 124, such as by welding or soldering. The cage mounting tabs 138 may be secured to the panel 108 using fasteners, such as screws. The cage mounting tabs 138 may be secured to the panel 108 using adhesive, welding, soldering, latches, a clip or other securing element in alternative embodiments. Optionally, an EMI shield may be provided between the cage mounting tabs 138 and the panel 108.

Figure 11:
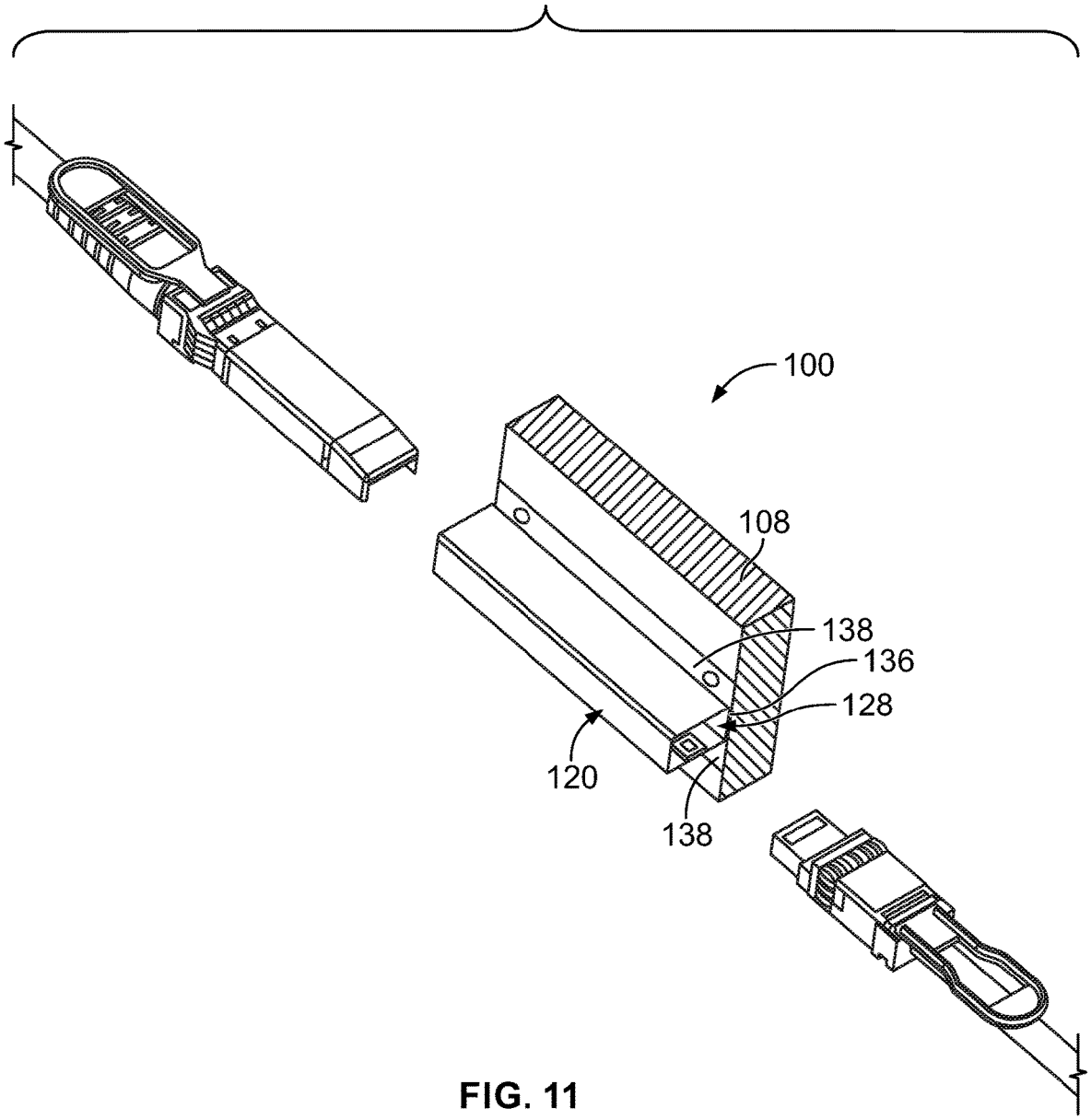
FIG. 11 is a rear perspective view of the communication system in accordance with an exemplary embodiment.

FIG. 11 is a rear perspective view of the communication system 100 in accordance with an exemplary embodiment. In the illustrated embodiment, the cage mounting tabs 138 of the receptacle cage 120 extend parallel to the longitudinal axis of the module channel 128. The cage mounting tabs 138 may be provided at the side wall 136, such as extending from the top and the bottom of the receptacle cage 120. The cage mounting tabs 138 are used to mount the receptacle cage 120 to the panel 108, which extends parallel to the longitudinal axis of the module channel 128. The cage mounting tabs 138 may be secured to the panel 108 using fasteners, such as screws. The cage mounting tabs 138 may be secured to the panel 108 using adhesive, welding, soldering, latches, a clip or other securing element in alternative embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication system comprising:

a plug module including a plug housing having conductive plug housing walls defining a plug module cavity, the plug housing walls including a top wall, a bottom wall and sidewalls between the top wall and the bottom wall, the plug module including a plug latch coupled to the plug housing, the plug latch including a plug latching feature and a plug release tab, the plug module including a plug module circuit board held by the plug housing in the plug module cavity, the plug module circuit board having a mating edge, the plug module including cables terminated to the plug module circuit board;

a receptacle module including a receptacle housing having conductive receptacle housing walls defining a receptacle module cavity, the receptacle housing walls including a top wall, a bottom wall and sidewalls between the top wall and the bottom wall, the receptacle module including a receptacle latch coupled to the receptacle housing, the receptacle latch including a receptacle latching feature and a receptacle release tab, the receptacle module including a receptacle connector received in the receptacle housing, the receptacle connector including a receptacle connector housing extending forward of the receptacle housing, the receptacle connector housing manufactured from a dielectric material, the receptacle connector housing having a card slot at a front of the receptacle connector housing receiving the mating edge of the plug module circuit board to electrically connect the plug module to the receptacle module, the receptacle connector including contacts held by the receptacle connector housing configured to be mated with the plug module circuit board, the receptacle connector including cables terminated to the contacts and extending rearward from the receptacle connector and the receptacle housing; and a receptacle cage having cage walls defining a module channel, the module channel extending between a front end and a rear end of the receptacle cage, the cage walls including a top wall, a bottom wall, and sidewalls extending between the top wall and the bottom wall, the receptacle cage having a front cage interface receiving the plug module at the front end and the receptacle cage having a rear cage interface receiving the receptacle module at the rear end, the front cage interface matching the rear cage interface, the receptacle cage including a front latching feature interfacing with the plug latch for latchably securing the plug module in the receptacle cage, the receptacle cage including a rear latching feature interfacing with the receptacle latch for latchably securing the receptacle module in the receptacle cage.

2. The communication system of claim 1, wherein the front cage interface is defined by the top wall, the bottom wall and the sidewalls of the receptacle cage, the front cage interface having a front port at the front end open to the module channel, the front cage interface including the front latching feature, and wherein the rear cage interface is defined by the top wall, the bottom wall and the sidewalls of the receptacle cage, the rear cage interface having a rear port at the rear end open to the module channel, the rear cage interface including the rear latching feature.

3. The communication system of claim 2, wherein a size and a shape of the front cage interface is identical to a size and a shape of the rear cage interface.

4. The communication system of claim 1, wherein the receptacle housing includes a receptacle mating interface defined by the top wall, the bottom wall, and the sidewalls of the receptacle housing, and wherein the plug housing includes a plug mating interface defined by the top wall, the bottom wall, and the sidewalls of the plug housing, the receptacle mating interface matching the plug mating interface.

5. The communication system of claim 4, wherein the receptacle mating interface includes the receptacle latching feature and the plug mating interface includes the plug latching feature.

6. The communication system of claim 4, wherein a size and a shape of the receptacle mating interface is identical to a size and a shape of the plug mating interface.

7. The communication system of claim 1, wherein the receptacle cage includes a cage mounting tab extending from at least one of the cage walls for mounting the receptacle cage to a support structure.

8. The communication system of claim 7, wherein the support structure is a host circuit board, the cage mounting tab including a press-fit pin configured to be press fit into a via of the host circuit board to secure the receptacle cage to the host circuit board.

9. The communication system of claim 7, wherein the support structure is a panel, the cage mounting tab being secured directly to the panel.

10. The communication system of claim 9, wherein the panel includes an opening, the panel being oriented perpendicular to a longitudinal axis of the module channel, the receptacle cage extending into the panel such that the front end of the receptacle cage is flush with or forward of a front surface of the panel and the rear end of the receptacle cage is flush with or rearward of a rear surface of the panel, the cage mounting tab being secured to at least one of the front surface or the rear surface of the panel.

11. The communication system of claim 9, wherein the panel extends parallel to a longitudinal axis of the module channel, the cage mounting tab extending parallel to the longitudinal axis of the module channel along the panel.

12. The communication system of claim 1, wherein the plug latching feature engages a front cage latching feature of the receptacle cage from inside the receptacle cage to secure the plug housing in the receptacle cage and wherein the receptacle latching feature engages a rear cage latching feature of the receptacle cage from inside the receptacle cage to secure the receptacle housing in the receptacle cage.

13. The communication system of claim 1, further comprising a front EMI gasket proximate to the front end of the receptacle cage and a rear EMI gasket proximate to a rear end of the receptacle cage, the front EMI gasket extending between and engaging both the cage walls of the receptacle cage and the plug housing, the rear EMI gasket extending between and engaging both the cage walls of the receptacle cage and the receptacle housing.

14. The communication system of claim 13, wherein the rear EMI gasket is coupled to the receptacle housing and plugged into the module channel with the receptacle module to engage the receptacle cage.

15. The communication system of claim 1, wherein the module channel has a channel envelope defined by the top wall, the bottom wall, and the side walls, the plug module housing and the receptacle module housing fitting within the channel envelope, wherein the receptacle cage further comprises a second module channel configured to receive a second plug module and a second receptacle module.

16. The communication system of claim 15, wherein the module channel and the second module channel are stacked vertically.

17. The communication system of claim 15, wherein the module channel and the second module channel are stacked horizontally being separated by only a single piece of sheet metal.

18. A communication system comprising:

a plug module including a plug housing having conductive plug housing walls defining a plug module cavity, the plug housing walls including a top wall, a bottom wall and sidewalls between the top wall and the bottom wall, the plug module including a plug latch coupled to the plug housing, the plug module including a plug module circuit board held by the plug housing in the plug module cavity, the plug module circuit board having a mating edge;

a receptacle module including a receptacle housing having conductive receptacle housing walls defining a receptacle module cavity, the receptacle housing walls including a top wall, a bottom wall and sidewalls between the top wall and the bottom wall, the receptacle module including a receptacle latch coupled to the receptacle housing, the receptacle module including a receptacle connector received in the receptacle housing, the receptacle connector including a receptacle connector housing extending forward of the receptacle housing, the receptacle connector housing manufactured from a dielectric material, the receptacle connector housing having a card slot at a front of the receptacle connector housing receiving the mating edge of the plug module circuit board to electrically connect the plug module to the receptacle module, the receptacle connector including contacts held by the receptacle connector housing configured to be mated with the plug module circuit board, the receptacle connector including cables terminated to the contacts and extending rearward from the receptacle connector and the receptacle housing; and a receptacle cage having cage walls defining a module channel, the module channel extending between a front end and a rear end of the receptacle cage, the cage walls including a top wall, a bottom wall, and sidewalls extending between the top wall and the bottom wall, the top wall, the bottom wall and the sidewalls being continuous between the front end and the rear end to enclose the module channel between the front end and the rear end, the receptacle cage receiving the plug module at the front end and receiving the receptacle module at the rear end, the receptacle cage having a cage mounting tab extending from at least one of the cage walls for mounting the receptacle cage to a support structure.

19. The communication system of claim 18, wherein the support structure is a panel, the panel including an opening, the panel being oriented perpendicular to a longitudinal axis of the module channel, the receptacle cage extending into the panel such that the front end of the receptacle cage is flush with or forward of a front surface of the panel and the rear end of the receptacle cage is flush with or rearward of a rear surface of the panel, the cage mounting tab being secured to at least one of the front surface or the rear surface of the panel such that the receptacle cage is supported by the panel independent of other supporting structures.

20. The communication system of claim 18, wherein the module channel has a channel envelope defined by the top wall, the bottom wall, and the side walls, the plug module housing and the receptacle module housing fitting within the channel envelope, wherein the receptacle cage further comprises a second module channel configured to receive a second plug module and a second receptacle module, the module channel and the second module channel being either stacked vertically or stacked horizontally.

21. A receptacle module configured to be plugged into a receptacle cage of a receptacle assembly for mating with a plug module plugged into the receptacle cage, the receptacle module comprising:

a receptacle housing having conductive housing walls defining a receptacle module cavity, the housing walls including a top wall, a bottom wall and sidewalls between the top wall and the bottom wall;

a receptacle latch coupled to the receptacle housing, the receptacle latch including a receptacle latching feature configured to engage a cage latching feature of the receptacle cage from inside the receptacle cage to secure the receptacle housing in the receptacle cage, the receptacle latch including a release tab to release the receptacle latching feature from the cage latching feature; and a receptacle connector received in the receptacle housing, the receptacle connector including a receptacle connector housing extending forward of the receptacle housing, the receptacle connector housing manufactured from a dielectric material, the receptacle connector housing having a card slot at a front of the receptacle connector housing configured to receive a plug module circuit board of the plug module, the receptacle connector including contacts held by the receptacle connector housing configured to be mated with the plug module circuit board, the receptacle connector including cables terminated to the contacts and extending rearward from the receptacle connector and the receptacle housing.

22. The receptacle module of claim 21, wherein the receptacle housing is narrower than the receptacle cage such that the receptacle housing does not extend any wider than sidewalls of the receptacle cage.

23. The receptacle module of claim 21, further comprising an EMI gasket coupled to the receptacle housing and plugged into the receptacle cage with the receptacle housing to engage the receptacle cage.

24. The receptacle module of claim 21, wherein the receptacle latching feature is located along at least one of the sidewalls or the bottom wall of the receptacle housing remote from the top wall of the receptacle housing.

25. A receptacle cage for mating a plug module and a receptacle module, the receptacle cage comprising:

cage walls defining a module channel, the module channel extending between a front end and a rear end of the receptacle cage, the cage walls including a top wall, a bottom wall, and sidewalls extending between the top wall and the bottom wall, the top wall, the bottom wall and the sidewalls being continuous between the front end and the rear end to enclose the module channel between the front end and the rear end;

a front cage interface defined by the top wall, the bottom wall and the side walls, the front cage interface having a front port at the front end open to the module channel, the front cage interface including a front latching feature;

a rear cage interface defined by the top wall, the bottom wall and the side walls, the rear cage interface having a rear port at the rear end open to the module channel, the rear cage interface including a rear latching feature;

wherein a size and a shape of the front cage interface is identical to a size and a shape of the rear cage interface; and wherein the front cage interface matches the rear cage interface such that the front cage interface is configured to receive either of the plug module or the receptacle module with the front latching feature securing the plug module or the receptacle module in the module channel, wherein the rear cage interface is configured to receive the other of the plug module or the receptacle module with the rear latching feature securing the plug module or the receptacle module in the module channel.

26. The receptacle cage of claim 25, further comprising a cage mounting tab extending from at least one of the cage walls for mounting the receptacle cage to a support structure.

27. The receptacle cage of claim 25, wherein the front latching feature is a deflectable latch extending into the module channel and wherein latching feature is a deflectable latch extending into the module channel.

* * * * *